US005520570A

United States Patent [19]

Kaiser, Jr.

[11] Patent Number: 5,520,570

[45] Date of Patent: May 28, 1996

[54] WORKPIECE RADIAL LOCATOR DEVICE AND METHOD

[75] Inventor: Russell E. Kaiser, Jr., Mercersburg, Pa.

[73] Assignee: Litton Industrial Automation Systems Inc., Del.

[21] Appl. No.: 100,543

[22] Filed: Jul. 30, 1993

[51] Int. Cl.[6] ..... B24B 5/00

[52] U.S. Cl. ..... 451/11; 451/249; 451/9

[58] Field of Search ..... 451/5, 8, 9, 62, 451/241, 242, 246, 247, 251, 11, 249

[56] References Cited

U.S. PATENT DOCUMENTS

| | | | |
|---|---|---|---|
| 2,693,060 | 2/1953 | Mader et al. | 451/249 |
| 2,693,061 | 3/1953 | Fred | 451/249 |
| 2,693,062 | 4/1953 | Silven et al. | 451/249 |
| 5,189,846 | 3/1993 | Griswold | 451/9 |

*Primary Examiner*—Bruce M. Kisliuk
*Assistant Examiner*—Derris Banks
*Attorney, Agent, or Firm*—Morris I. Pollack

[57] ABSTRACT

A radial locator is carried by the bed of a cam lobe grinding machine proximate the workpiece chuck. An initial locating pin is carried by the chuck to sense a rough locating hole in a sprocket carried by a cam shaft to be disposed in the chuck to have its cam lobes ground. A timing tooth is provided on the sprocket in proper proximity to the rough locating hole and for coaction with complimentary locating teeth carried by a rockable locating arm of the radial locator. An actuating arm carries the locating arm for movement between an at rest disposition and a rocked disposition wherein the locator teeth coact with the timing tooth to rotate the sprocket, cam shaft and cam lobes to a final position for proper grinding of the cam lobes. A rotary actuator moves the actuating arm an locating arm between their respective dispositions.

40 Claims, 4 Drawing Sheets

FIG. 7
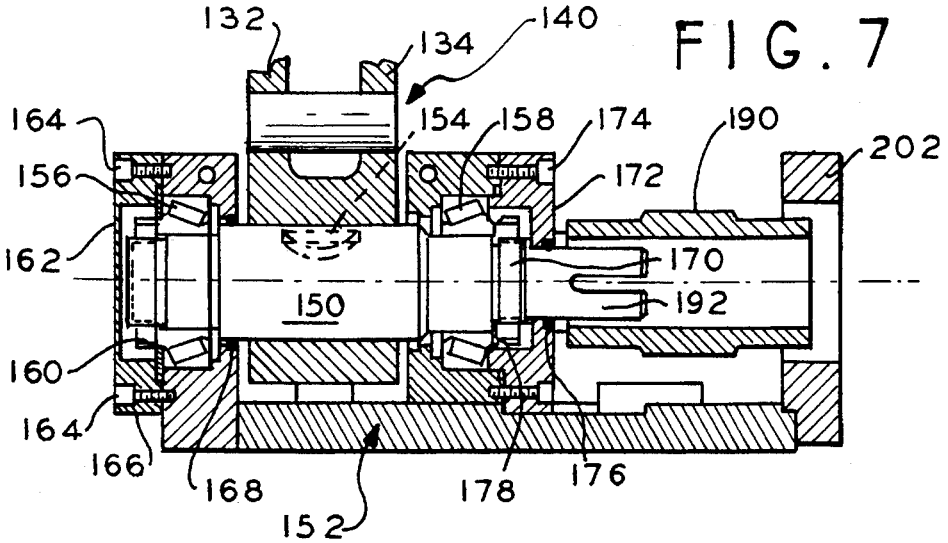
FIG. 4A
FIG. 5
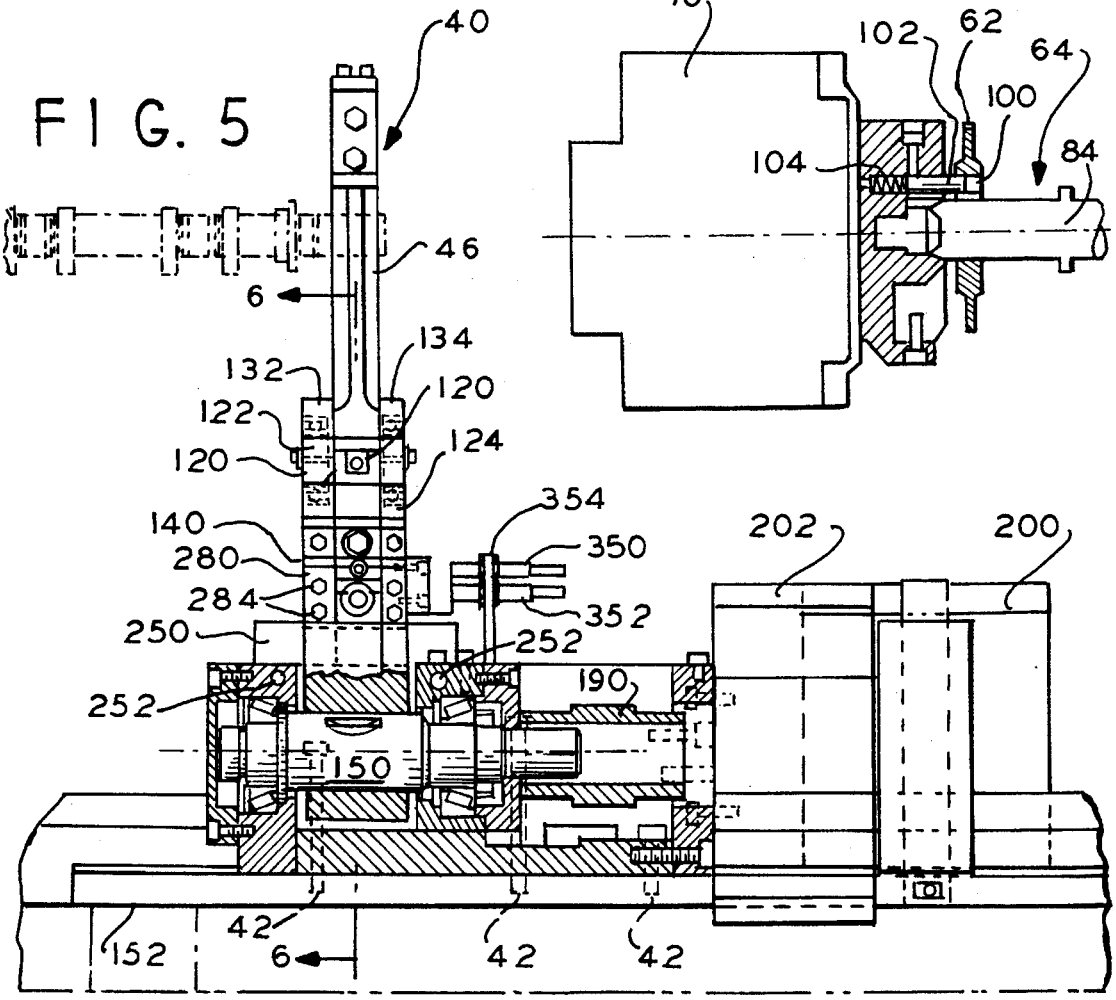

WORKPIECE RADIAL LOCATOR DEVICE AND METHOD

FIELD OF APPLICATION

This invention relates to the locating and positioning of a workpiece in a machine tool and/or with respect to the worktool thereof; and, more particularly, to the radial locating and positioning of a workpiece.

BACKGROUND OF THE INVENTION

Many manufacturing processes include the fixing of the article to be worked on (i.e. the workpiece) in a chuck, workhead or the like and the subsequent rotation of that chuck or workhead, and the workpiece carried thereby about a predetermined axis of rotation that quite often extends through the workpiece. The workpiece may be a piece of raw stock or it may be a partially manufactured item or assembly of parts. In many instances the machining or manufacturing process requires the accurate locating and positioning of the workpiece in the chuck or workhead and with respect to the worktool or other reference carried by the machine tool.

Rough positioning of a part to be machined or otherwise subjected to a manufacturing process is sometimes accomplished by a feeler or probe that senses a locating characteristic or object carried by the workpiece. Such characteristic or object may be a hole, dimple, groove, rib or similar and intended locating mark provided on the workpiece. However, rough positioning, especially in a radial sense, may be insufficient to locate and position some workpieces for particular manufacturing operations; especially those that require an accurate machining of the peripheral configuration of the part or parts such as that of a cam or cams on a cam shaft.

SUMMARY OF THE INVENTION

It is therefore an object of this invention to provide a new and improved device for locating and positioning a workpiece for a manufacturing process.

It is another object of this invention to provide a new and improved method of locating and positioning a workpiece for a manufacturing process.

It is yet another object of this invention to provide a new and improved device for radially locating and positioning a workpiece for a manufacturing process.

It is still another object of this invention to provide a new and improved method of radially locating and positioning a workpiece for a manufacturing process.

It is a further object of this invention to provide a new and improved device and method for locating and positioning a workpiece for a manufacturing process by rotating the workpiece about an axis of rotation passing through the workpiece until the workpiece is moved into a selected disposition.

It is yet another object of this invention to provide a new and improved device and method for locating and positioning a cam shaft for grinding.

It is yet still another object of this invention to provide a new and improved device and method for locating and positioning a cam shaft for grinding of the cam lobes thereof.

Other objects, features and advantages of this invention in its details of construction and arrangement of parts will be seen from the above, from the description of the preferred embodiment when considered with the drawing and from the appended claims.

BRIEF DESCRIPTION OF THE DRAWING

In the drawing:

FIG. 4A is a schematic of an initial or rough radial locator for use with the workpiece and workpiece locator/positioner of FIGS. 1–4, rotated slightly to better show details thereof;

FIG. 5 is a rear elevation view of the workpiece locator/positioner of FIGS. 1–4, with a portion of a workpiece shown in phantom;

FIG. 7 is a section, in elevation taken on line 7—7 of FIG. 2; and

DESCRIPTION OF THE PREFERRED EMBODIMENT

Figure 2:
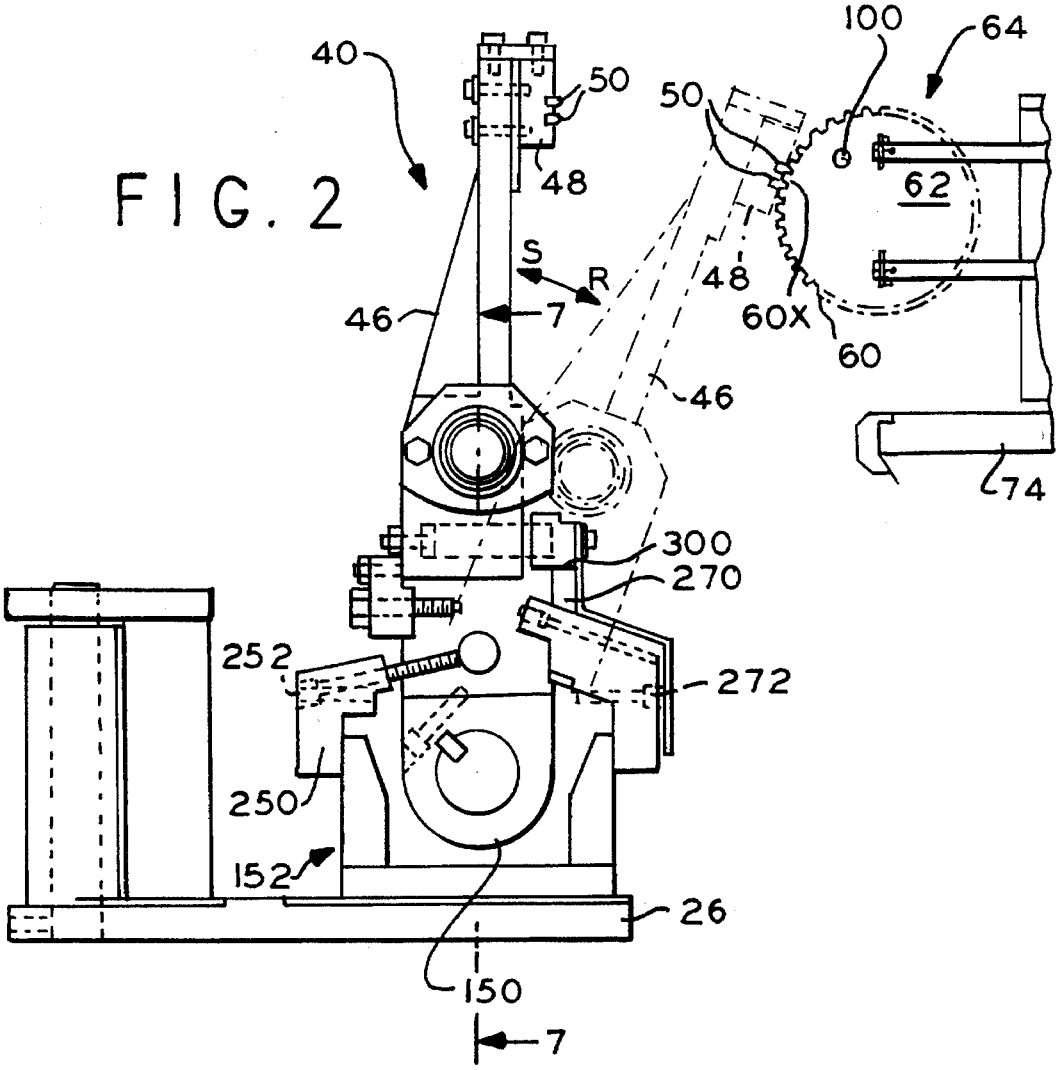
FIG. 2 is an enlarged showing of the workpiece and workpiece locator/positioner of FIG. 1, with a portion of the machine tool shown in phantom.
Figure 1:
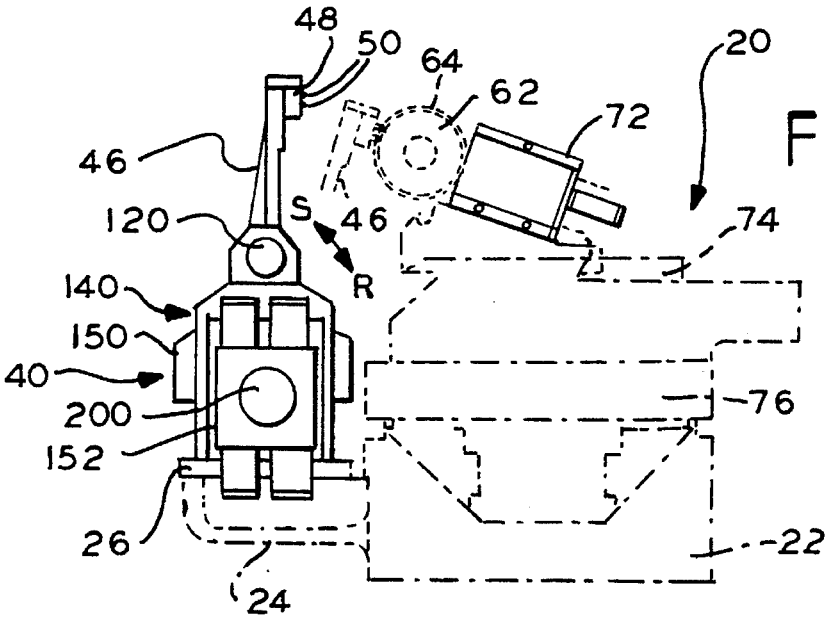
FIG. 1 is a reduced size schematic of a machine tool, workpiece, and workpiece locator and positioner incorporating the instant invention.
Figure 3:
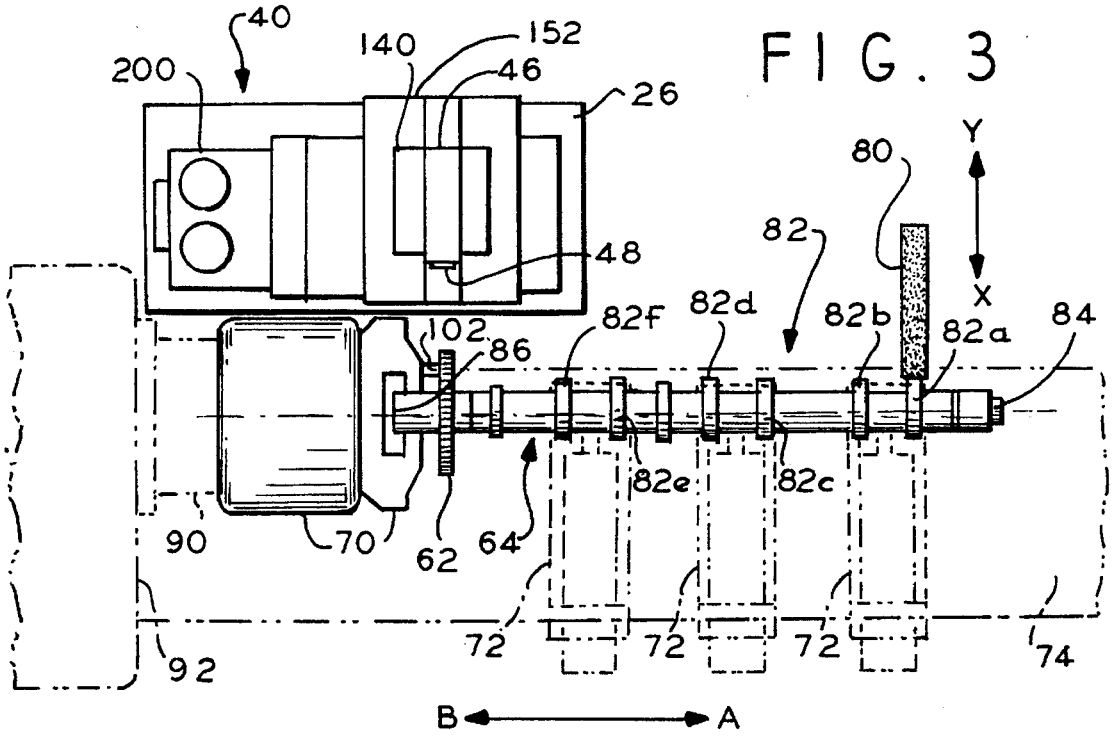
FIG. 3 is a plan view of the workpiece and workpiece/locator positioner of FIGS. 1 and 2 with portions of the machine tool shown in phantom.
Figure 4:
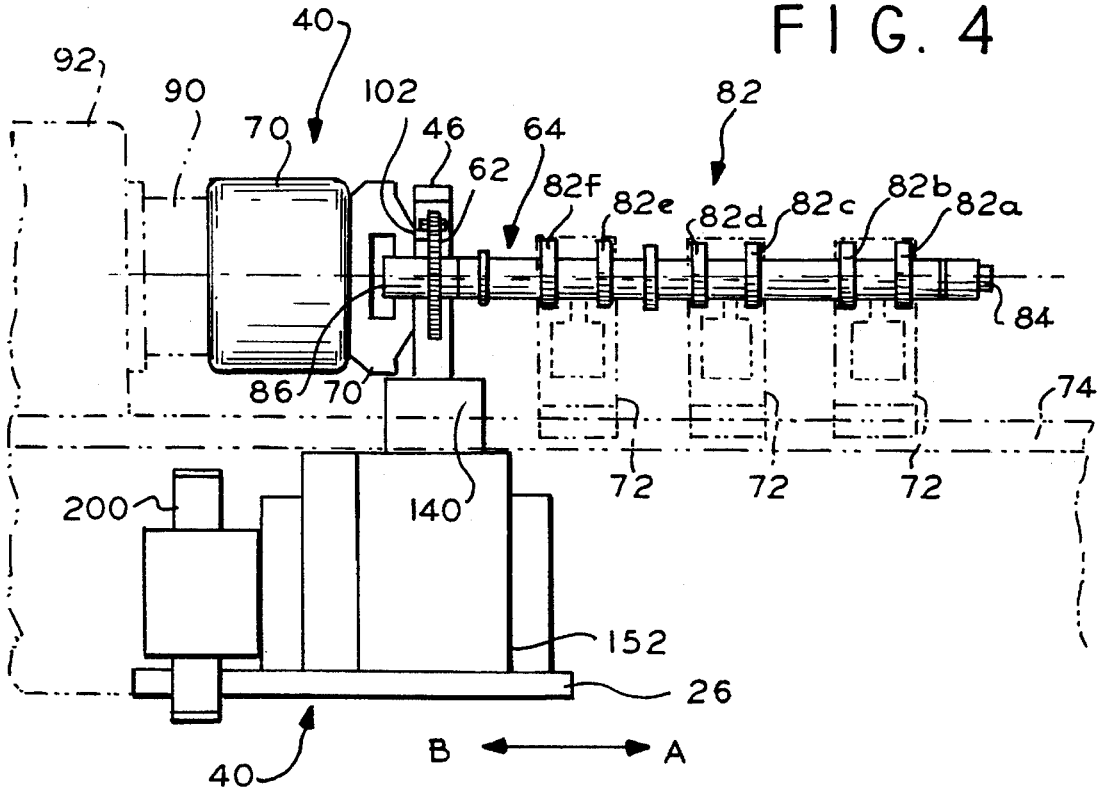
FIG. 4 is a front elevation view of the workpiece and workpiece locator/positioner of FIGS. 1–3 with portions of the machine tool shown in phantom.

With reference to FIG. 1, there is schematically shown at 20 a machine tool with a bed 22 including a portion 24 to which a bracket 26 (FIGS. 1–4) is secured as by conventional means such as threaded members or the like (not shown). A workpiece locator/positioner device 40 is mounted to bracket 26, as by threaded members such as socket head screws 42 (FIGS. 2 and 5) or the like, and so that a rockably mounted locator arm 46, may be moved between an "at rest" disposition (FIGS. 1 and 2) and a workpiece locating/positioning disposition (shown in phantom in FIGS. 1 and 2). A workpiece locating shoe 48 is carried by arm 46 so that in the workpiece locating disposition of arm 46 locating teeth 50 (FIG. 2) carried by shoe 48 coact with teeth 60 of a sprocket 62 (FIGS. 1 and 2) of a workpiece 64 (FIGS. 1–4) when workpiece 64 is disposed in a chuck 70 (FIGS. 3 and 4) and on one or more workrests 72 carried by a worktable 74 (FIGS. 1–4) that is, in turn, carried by a workcarriage 76 mounted for selected longitudinal movement on machine tool bed 22 in conventional manner and by conventional means.

Machine tool 20, in this instance, is a grinding machine with a grinding wheel 80 (FIG. 3) and workpiece 64 is a cam shaft having a plurality of cam lobes 82 (**82*a*–82*f*) carried by a cam shaft 84. An end 86 of cam shaft 84 is mounted in chuck 70 in conventional manner. A chuck adaptor 90 is utilized to mount chuck 70 to a headstock 92 carried by worktable 74 of machine tool 20 and through which desired rotation is imparted through chuck adaptor 90 to chuck 70 and cam shaft 84 mounted therein. Headstock 92, adaptor 90, and chuck 70 are of conventional construction and operation (through motors and controls of machine tool 20). Other chucks with or without adaptors may be utilized to impart the desired rotation to cam shaft 84. Machine tool 20 also includes conventional mechanisms and controls for escaping or indexing work table 74 in the direction of arrow "A" (FIGS. 3 and 4) to successively present cam lobes 2***a*–82*f* to grinding wheel 80, for controlling the rotation of grinding wheel 80 and its movements in the directions of arrows "X" and "Y" (FIG. 3) to grind cam lobes 82*a*–82*f* under CNC control, and for returning work table 74 in the direction of arrow "B" to start the cycle over again.

Cam lobes 82*a*–82*f* must be accurately ground not only so that their respective cam lobes have a predetermined profile but also so that their respective phase angles are properly and accurately located and defined. In some instances location of the phase angle is to be determined with respect to a particular tooth or particular teeth on a sprocket secured to the cam shaft. In this instance sprocket 62 is formed with sprocket teeth 60 and is provided with a rough locating hole 100. A locating pin 102 (FIGS. 3, 4 and 4A), of conventional construction and operation is carried by chuck 70 and urged by a spring 104 (FIG. 4A) into a position of coaction with hole 100 and upon a slow initial locating rotation of cam shaft 84 and sprocket 62 with respect to chuck 70 and pin 102 will under urging of spring 104 sense hole 100 and stop initial rotation of sprocket 62 and cam shaft 84 in a "rough" or initial locating position. Thereafter, workpiece locator/positioner device 40 is operated, as will be hereinafter described in greater detail, to rock arm 46 in the direction of arrow "R" (FIGS. 1 and 2) moving its locating teeth 50 towards a timing tooth 60*x* of sprocket 62 which will be appropriately positioned when locating pin 102 is so disposed in hole 100. Locating teeth 50 and sprocket timing tooth 60*x* each have complimentary curved side configurations so that when locating sprocket or timing tooth 60*x* enters between locating teeth 50 the respective sides thereof coact and sprocket 62 is rotated about its axis of rotation in either a clockwise or counterclockwise direction (FIGS. 1 and 2) until the coacting timing tooth 60*x* is seated between locating teeth 50. At that instance chuck 70 is locked up and cam shaft 84 and its unground cam lobes 82*a*–82*f* are properly located for subsequent grinding by grinding wheel 80. The relative sizes of the OD of locating pin 102 and ID of hole 100 are selected so that there is sufficient clearance to permit the aforedescribed coaction of locating teeth 50 and timing tooth 62*x* and subsequent positioning of sprocket 62, cam shaft 84 and cam lobes 82. While an initial locating object or characteristic 100 is shown to be a hole and final locating characteristic or object 60*x* is a sprocket timing tooth other locating characteristics or objects may be employed.

Locating arm 46 is carried by a locating arm shaft 120 (FIGS. 5 and 6) the ends of which are mounted within bearings 122, 124 (FIG. 5) carried by spaced arms 132, 134 of a "U" shaped actuating arm 140 that is, in turn, carried by an actuating arm shaft 150 (FIGS. 5–8) carried by an actuating arm base 152 secured to bracket 26 by threaded members 42 (FIG. 5). A securing device, such as a woodruff key 154 (FIG. 7) or the like, secures actuating arm 140 to its shaft 150. A pair of spaced bearings 156, 158 receive reduced diameter portions of shaft 150 and serve to rotationally mount shaft 150 to base 152. Another securing device, such as a taper line locknut 160, functions to retain bearing 156 in place and an end cap 162 closes the opening in base 152 providing access to nut 160 and bearing 156 by being secured to base 152 through suitable means such as threaded members 164. If desired, an O-ring 166 and an oil seal 168 may be provided between end cap 162 and base 152 and between base 152 and shaft 150 respectively because bearing 156 is pre-greased. In similar manner a taper-line locknut 170, or similar securing device, is utilized to retain bearing 158 in position and an end cap 172, secured to base 152 by threaded member 174 or the like, is utilized to close the opening into base 172 providing access to nut 170 and bearing 158. An O-ring 176 and an oil seal 178 may be provided between end cap 172 and base 152 and between base 152 and shaft 150 respectively because bearing 158 is pre-greased.

A coupling 190 (FIGS. 5 and 7) such as a Boston Gear shaft coupling or the like, connects an end 192 of shaft 150 to a rotary actuator 200 which may be a "FLO-TORK" rotary actuator or similar rotary actuator. A plate 202, secured to base 152 by suitable means, is secured to rotary actuator 200, by threaded members 204 (FIG. 5) or the like, and mounts actuator 200 to base 152. Conventional and appropriate controls are connected to actuator 200 to control the operation thereof.

A slot 220 (FIGS. 6 and 8) is provided in a base 222 of "U" shaped actuating arm 140 to facilitate disposition of actuating arm shaft 150 in an opening 224 formed through base 222 of arm 140. A set screw 226 spans slot 220 and when tightened draws the sides of slot 220 towards each other to further secure arm 140 and shaft 150 together.

Figures 6, 8:
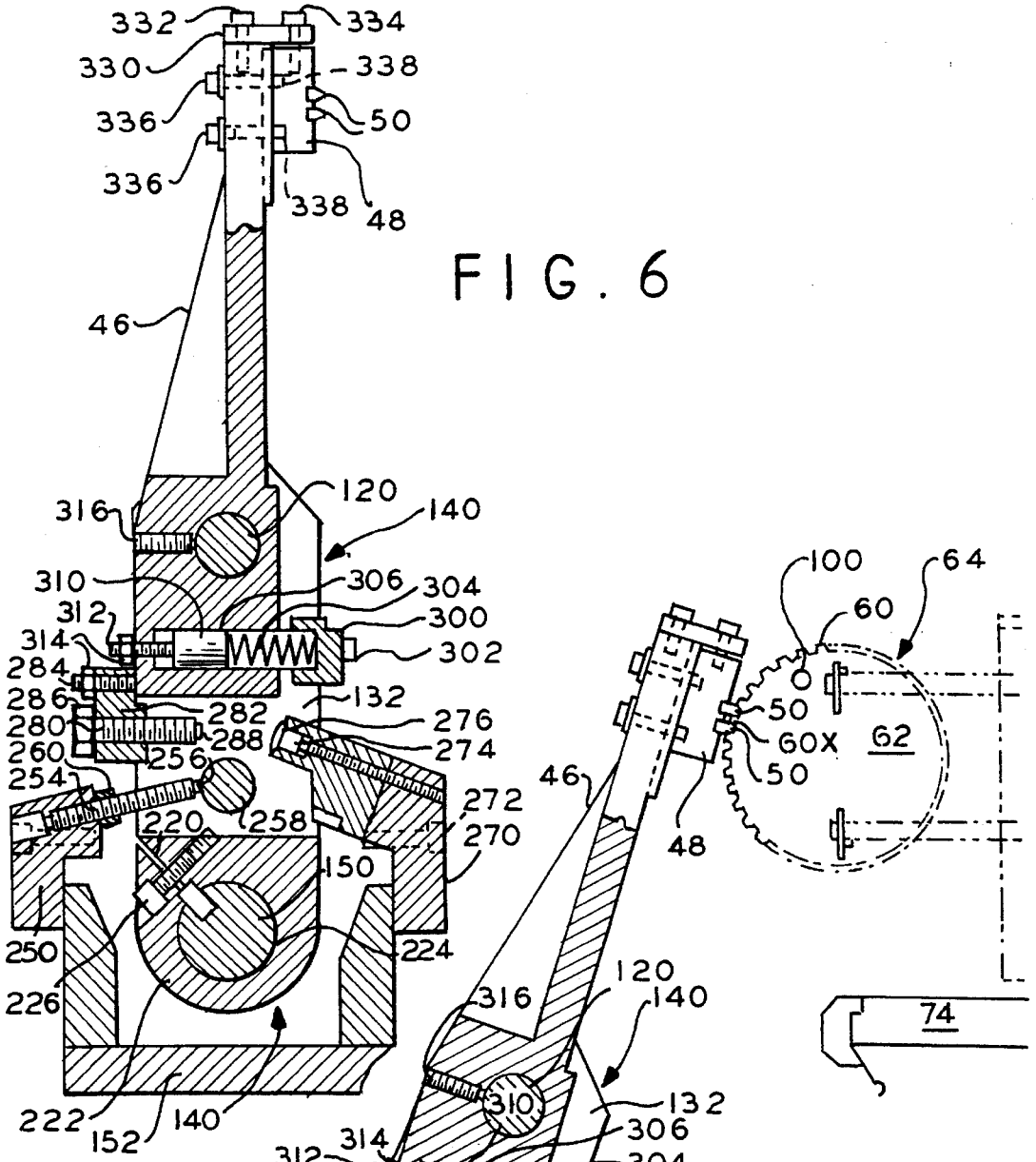
FIG. 6 is a section, in elevation, taken on line 6—6 of FIG. 5 showing the workpiece locator/positioner in its "at rest" dispositioner.
FIG. 8 is a view similar to FIG. 6 but showing the workpiece locator/positioner in its workpiece locating/positioning disposition.

A first stop bracket 250 (FIGS. 2, 5, 6 and 8), secured to base 152 by suitable means such as threaded members 252 (FIGS. 2 and 5) or the like, mounts a first fixed stop 254 (FIGS. 6 and 8) in the form of an externally threaded shaft one end of which is threaded into bracket 250 and the other end 256 of which is disposed to coact with a dowel pin 258 that spans the space between and is carried by arms 132, 134 of actuating arm 140 to arrest actuating arm 140 in its "at rest" disposition of FIG. 6. An internally threaded nut 260 is threaded onto stop 254 and rests against stop bracket 250 when end 256 of stop 254 is properly set to coact with dowel pin 258. A second stop bracket 270 (FIGS. 6 and 8) also secured to base 152 by suitable means such as threaded members 272 or the like, mounts a second fixed stop 274 in the form of a special radius locator button 276 the other end of which is threadably received in stop bracket 270. Button 276 is disposed in the path of movement of a movable stop 280 (FIGS. 6 and 8) threadably carried by a mounting plate 282 (FIGS. 5, 6 and 8) by a plurality of threaded members such as screws 284, fixedly secured, to, and carried by, spaced arms 132, 134 of actuating arm 140. A nut 286, threaded onto one end of movable stop 280, serves to fix the adjusted position of a stop end 288 of stop 280 so as to arrest rocking of actuating arm 140 in the workpiece locator/positioner disposition (FIG. 8). The external threads on movable stop 280 permit selective adjustment of stop 280 and its end 288.

A spring retainer 300 (FIGS. 2, 6 and 8), also spanning spaced arms 132, 134 of actuating arm 140 and secured thereto as by threaded set screws 302 or the like, receives one end of a compression spring 304 the other end of which is received in a bore 306 formed in locator arm 46. A spacer 310, also housed in bore 306, may be adjustably positioned in bore 306 by a screw 312 that is held in its adjusted positions by a nut 314. Selective adjustment of the position of screw 312 and thereby of spacer 310 serves to adjust the compression of spring 304. A dog point set screw 316, or similar device, is utilized to fix locator arm 46 to shaft 120. An adjustor block 330, secured to the top of locator arm 46 by set screws 332 or the like, is, in turn, secured to and serves to mount locator shoe 48 by means of threaded members 334 or the like. A pair of socket head screws 336, or similar threaded members or the like, threadably carried by locator arm 46, and provided with ends 338 that extend into locator shoe 48 along with threaded members 334 and adjustor block 330 mount locator shoe 48 on locator arm 46 so that locator teeth 50 carried by shoe 48 may be selectively positioned on arm 46 and for subsequent coaction with tooth 60*x* of sprocket 62.

The final disposition of locator arm 46 on shaft 120, the mounting thereof between arms 132, 134 of actuating arm 140, and the effect of spring 304 and its positioning between arm 46 and arm 140 provides a limited degree of rotation or rocking of locator arm 46 about the axis of rotation of shaft 120 and with respect to actuating arm 140. The positioning of fixed stop 274 and of end 288 of movable stop 280 are such that when actuator arm 140 is rocked by actuator 200 from the "at rest" disposition (FIG. 6) for arm 140 to its workpiece locating/positioning disposition (FIG. 8) locator teeth 50 of arm 46 will engage the selected tooth 60*x* of sprocket 62 before stop end 288 engages locator button 276 of fixed stop 274. Further clockwise rocking movement of actuator arm 140 to seat movable stop 288 against button 276 and the coaction of locator teeth 50 with locator or timing tooth 60*x* of sprocket 62 during such movement effects the limited counterclockwise rotation of locator arm 46 about the axis of rotation of shaft 120 (FIG. 8) hereinabove described applying a selected force against sprocket 62 to rotate same in either a clockwise or counterclockwise direction (as needed) to properly locate and position sprocket 62 and its cam shaft 84 and cam lobes 82*a*–82*f* for grinding by grinding wheel 80 of grinding machine 20.

A pair of proximity switches 350, 352 (FIG. 5) carried by a switch bracket 354 secured to base 152 and connected into the control circuitry, all by suitable and appropriate means, sense and indicate the "at rest" (FIG. 6) and workpiece locating/positioning (FIG. 8) dispositions of actuating arm 140.

With the grinding machine 20 at rest, a workpiece 64, in the form of a camshaft 84 with its cam lobes 82*a*–82*f* and its sprocket 62, is set on workrests 72 with shaft end 86 positioned in but not chucked-up in chuck 70 and with sprocket 62 laterally aligned with locator arm 46. Cam shaft 84 is rotated so that initial locator probe or pin 102 finds rough or initial locating hole 100, as hereinabove described. Rotary actuator 200 (FIG. 5) is then operated and through coupling 190 and shaft 150 (FIG. 7) rocks actuator arm 140 in the clockwise direction (FIG. 2) about the axis of rotation of shaft 150 until end 288 (FIG. 6) of movable stop 280 stops such rocking motion by contacting button 276 of fixed stop 274 (FIG. 8). Locator arm 46 will also be rocked in the clockwise direction about the axis of rotation of shaft 150 by such rocking motion of actuator 140 and until locator teeth 50 of shoe 48 of arm 46 find location object or tooth 60*x* of sprocket 62. As actuator arm 140 finishes its clockwise rocking, however, the coaction between locator teeth 50 and sprocket 62 will urge locator arm 46 and its pin 120 in the counterclockwise direction (FIGS. 6 and 8) about the axis of rotation of pin 120 and against the bias of spring 304 establishing forces between teeth 50 of shoe 48 of arm 46 and timing tooth 60*x* of sprocket 62 to effect rotation of sprocket 62 in either the clockwise or counterclockwise direction about its axis or rotation (as needed) to move sprocket 62 cam shaft 84 and unground cam lobes 82*a*–82*f* into the desired position for grinding by grinding wheel 80. Once so positioned chuck 70 is tightened up to secure cam shaft 84 and its cam lobes 82*a*–82*f* in position for grinding. Rotary actuator 200 is operated to rock actuating arm 140 in the counterclockwise direction carrying locator arm 46 with actuating arm 140. Spring 304 rocks locator arm 46 in the clockwise direction returning it against stop 284 and pin 258 carried by actuating arm 140 moves against end 256 of fixed stop 254 to stop the counterclockwise rocking of actuating arm 140. When cam shaft workpiece 84 is thus set up for machining machine tool 20 can be operated to bring each cam lobe 82*a*–82*f* into alignment with grinding wheel 80 to be ground thereby until all lobes 82*a*–82*f* have been properly ground. After cam lobes 82*a*–82*f* have been ground chuck 70 is loosened and cam shaft 84 moved in a direction away from chuck 70 so that locating pin 102 leaves hole 100. While cam shaft 82 has been shown and described as having six cam lobes cam shafts with more or less cam lobes may also be ground utilizing locating device 40.

From the above description it will thus be seen that there has been provided a new and novel radial locator and method for use with a workpiece to be machined for locating the workpiece into a predetermined rotary disposition prior to grinding the workpiece.

It is understood that although I have shown the preferred embodiments of my invention that various modifications may be made in the details thereof without departing from the spirit as comprehended by the following claims.

What is claimed is:

1. A device for radially locating and positioning a workpiece for a machining process wherein the workpiece is to be rotatively positioned for the machining process and carries at least a single locating object; comprising:

(a) support means for positioning the locating/positioning device at a predetermined location on a machine tool proximate where the workpiece is to be mounted to the machine tool for the machining process;

(b) locating means carried by said support means for movement between a first at rest disposition and a second disposition wherein the locating means will coact with the locating object carried by the workpiece when so mounted to the machine tool and rotatively move the workpiece into a predetermined position that facilitates the machining of the workpiece; and (c) actuating means carried by said support means and coacting with said locating means to move said locating means between said first disposition and said second disposition thereof.

2. The locating/positioning device of claim 1, wherein the workpiece carries a plurality of objects similar to the locating object and also carries an initial locating object in proximity to said single locating object; the device further including:

(a) initial locating means disposed for coaction with the initial locating object when the workpiece is mounted to the machine tool for machining thereby;

(b) said actuating means being controlled to coact with said locating means after said initial locating means has coacted with said initial locating object.

3. The locating/positioning device of claim 1, wherein said locating means includes:

(a) actuating arm means rockably carried by said support means and locator arm means carried by said actuating arm means;

(b) said actuating means coacting with said locating means to rock said actuating arm means towards and away from a workpiece when the workpiece is mounted to the machine tool;

(c) said actuating arm means carrying said locator arm means towards and a way from the workpiece as said actuating arm means is so rocked by said locating means.

4. The locating/positioning device of claim 3, wherein said locator arm means is rockably carried by said actuating arm means.

5. The method of locating and positioning a workpiece for a machining process wherein the workpiece is to be rotatively disposed for the machining process and carries at least a single locating object; comprising:

(a) positioning the workpiece to be machined;

(b) rotating the workpiece to a predetermined initial or rough location;

(c) sensing the single locating object; and (d) effecting movement of the workpiece to a predetermined final location in response to sensing of the single locating object.

6. The method of claim 5, including:

(a) providing an initial or rough locating object on said workpiece;

(b) sensing said initial or rough locating object prior to sensing said single locating object.

7. The method of claim 6, including:

(a) forming said initial locating object as a hole; and (b) forming said single locating object as a timing tooth.

8. The method of claim 7, wherein the machining process is a grinding process.

9. The method of claim 8, wherein the workpiece is a cam shaft with at least one cam lobe.

10. The method of claim 9, wherein the cam shaft carries a sprocket which, in turn, carries said hole and said timing tooth.

11. A device for locating and positioning a workpiece for a machining process wherein the workpiece is to be rotatively disposed for the machining process and carries at least one multi-toothed sprocket including a particular tooth that constitutes a locating tooth and a hole formed in the workpiece proximate the particular tooth; comprising:

(a) support means for positioning the locating/positioning device at a predetermined location on a machine tool proximate where the workpiece is to be mounted to the machine tool for the machining process;

(b) locating means carried by said support means for movement between a first at rest disposition and a second disposition wherein the locating means will coact with the particular tooth carried by the workpiece when so mounted to the machine tool and move the workpiece into a predetermined position that facilitates the machining of the workpiece;

(c) actuating means carried by said support means and coacting with said locating means to move said locating means between said first disposition and said second disposition thereof; and (d) initial locating means disposed for coaction with the hole when the workpiece is mounted to the machine tool;

(e) said actuating means being controlled to coact with said locating means after said initial locating means has coacted with the hole.

12. The locating/positioning device of claim 11, wherein the workpiece is a cam shaft, the machine tool is a grinding machine and the machining process is the grinding of the cam lobes on the cam shaft with reference to the particular locating tooth; said locating means coacting with the sprocket carried by the cam shaft to rotate the cam shaft into position for grinding the cam lobes thereof.

13. The locating/positioning device of claim 12, wherein the particular tooth is a timing tooth.

14. The locating/positioning device of claim 12, wherein the machine tool includes a chuck that receives and rotatively carries the workpiece and said support means is fixedly carried by the machine tool proximate the chuck.

15. The locating/positioning device of claim 14, wherein said initial locating means is carried by the chuck for coaction with the initial locating object.

16. The locating/positioning device of claim 15, wherein the workpiece is a cam shaft with a sprocket carried proximate one end thereof and the initial locating object is a hole at a predetermined location on the sprocket.

17. The locating/positioning device of claim 16, wherein said initial locating means is a locating pin of a size and configuration to coact with the hole in the sprocket; and a spring carried by the chuck urges said locating pin towards the sprocket and into coaction with the initial locating object.

18. A device for locating and positioning a workpiece for a machining process wherein the workpiece is to be rotatively disposed for the machining process and carries at least a single locating object; comprising:

(a) support means for positioning the locating/positioning device at a predetermined location on a machine tool proximate where the workpiece is to be mounted to the machine tool for the machining process;

(b) locating means carried by said support means for movement between a first at rest disposition and a second disposition wherein the locating means will coact with the locating object carried by the workpiece when so mounted to the machine tool and move the workpiece into a predetermined position that facilitates the machining of the workpiece;

(c) actuating means carried by said support means and coacting with said locating means to move said locating means between said first disposition and said second disposition thereof;

(d) said locating means including actuating arm means rockably carried by said support means and locator arm means rockably carried by said actuating arm means;

(e) said actuating means coacting with said locating means to rock said actuating arm means towards and away from a workpiece when the workpiece is mounted to the machine tool;

(f) said actuating arm means carrying said locator arm means towards and away from the workpiece as said actuating arm means is so rocked by said locating means;

(g) a first fixed stop carried by said support means for coaction with a first stop carried by said actuating arm means and coacting with said first fixed stop to arrest rocking movement of said actuating arm means in said first at rest disposition of said locating means; and (h) a second fixed stop carried by said support means for coaction with a second stop carried by said actuating arm means and coacting with said second stop to arrest rocking movement of said actuating arm means in said second disposition of said locating means.

19. The locating/positioner device of claim 18, wherein:

(a) said locator arm means carries a pair of relatively closely spaced locator members which are disposed thereon for coaction with the single locating object when said locator arm means is carried by said actuating arm means into said second disposition; and (b) said locator arm means further carrying spring means disposed for coaction with said actuating arm means as said actuating arm means moves towards said second disposition thereof and prior to said actuating arm means being arrested in said second disposition thereof;

(c) said locator arm means being rocked with respect to said actuating arm means upon coaction between said locator members and the single locating object and thereby effecting movement of the workpiece into said predetermined position thereof.

20. The locating/positioning device of claim 19, wherein said locator members are carried by a shoe that is, in turn, adjustably carried by said locator arm means.

21. The locating/positioning device of claim 20, wherein the workpiece is a cam shaft carrying proximate one end thereof a sprocket and the single locating object is a timing tooth carried by the sprocket, said locator members comprising a pair of teeth having configurations that correspond to and coact with the timing tooth.

22. The locating/positioning device of claim 21, including:

(a) a first proximity switch disposed proximate said actuating arm means to sense and indicate that said actuating arm means is in said first disposition thereof; and (b) a second proximity switch disposed proximate said actuating arm means to sense and indicate that said actuating arm means is in said second disposition thereof.

23. The locating/positioning device of claim 22, wherein said actuating means includes a rotary actuator.

24. A grinding machine for grinding a workpiece wherein the workpiece is to be rotatively disposed for grinding and carries at least a single locating object; comprising:

(a) support means carried by the grinding machine and positioning a locating/positioning device at a predetermined location on the grinding machine proximate where the workpiece is to be ground;

(b) said locating/positioning device including at least;

(i) locating means carried by said support means for movement between a first at rest disposition and a second disposition wherein the locating means will coact with the single locating object carried by the workpiece when so mounted to the grinding machine and rotatably move the workpiece into a predetermined position that facilitates the grinding of the workpiece; and (ii) actuating means carried by said support means and coacting with said locating means to move said locating means between said first disposition and said second disposition thereof.

25. The grinding machine device of claim 24, wherein the workpiece carries a plurality of objects similar to the locating object and also carries an initial locating object in proximity to said single locating object; the device further including:

(a) initial locating means disposed for coaction with the initial locating object when the workpiece is mounted to the grinding machine;

(b) said actuating means being controlled to coact with said locating means after said initial locating means has coacted with said initial locating object.

26. The grinding machine device of claim 24, wherein said locating means includes:

(a) actuating arm means rockably carried by said support means and locator arm means carried by said actuating arm means;

(b) said actuating means coacting with said locating means to rock said actuating arm means towards and away from a workpiece when the workpiece is mounted to the grinding machine;

(c) said actuating arm means carrying said locator arm means towards and a way from the workpiece as said actuating arm means is so rocked by said locating means.

27. The grinding machine of claim 26, wherein said locator arm means is rockably carried by said actuating arm means.

28. A grinding machine for grinding a workpiece wherein the workpiece is to be rotatively disposed for grinding and carries at least one multi-toothed sprocket including, a particular tooth that constitutes a locating tooth, and a hole formed in the workpiece proximate the particular tooth comprising:

(a) support means carried by the grinding machine and carrying a locating/positioning device at a predetermined location on the grinding machine proximate where the workpiece is to be ground;

(b) said locating/positioning device including at least;

(i) locating means carried by said support means for movement between a first at rest disposition and a second disposition wherein the locating means will coact with the particular tooth carried by the workpiece when so mounted to the grinding machine and move the workpiece into a predetermined position that facilitates the grinding of the workpiece;

(ii) actuating means carried by said support means and coacting with said locating means to move said locating means between said first disposition and said second disposition thereof; and (iii) initial locating means disposed for coaction with the hole when the workpiece is mounted to the grinding machine;

(iv) said actuating means being controlled to coact with said locating means after said initial locating means has coacted with the hole.

29. The grinding machine of claim 28, wherein the workpiece is a cam shaft and the grinding is the grinding of the cam lobes on the cam shaft with reference to the particular locating tooth; said locating means coacting with the sprocket carried by the cam shaft to rotate the cam shaft into position for grinding the cam lobes thereof.

30. The grinding machine of claim 29, wherein the particular tooth is a timing tooth.

31. The grinding machine of claim 29, wherein the grinding machine includes a chuck that receives and rotatively carries the workpiece and said support means is fixedly carried by the grinding machine proximate the chuck.

32. The grinding machine of claim 31, wherein said initial locating means is carried by the chuck for coaction with the initial locating object.

33. The grinding machine of claim 32, wherein the workpiece is a cam shaft with a sprocket carried proximate one end thereof and the initial locating object is a hole at a predetermined location on the sprocket.

34. The grinding machine of claim 33, wherein said initial locating means is a locating pin of a size and configuration to coact with the hole in the sprocket; and a spring carried by the chuck urges said locating pin towards the sprocket and into coaction with the initial locating object.

35. A grinding machine for grinding a workpiece wherein the workpiece is to be rotatively disposed for grinding and carries at least as single locating object; comprising:

(a) support means carried by the grinding machine and carrying a locating/positioning device at a predetermined location on the grinding machine proximate where the workpiece is to be ground;

(b) said locating/positioning device including at least;

(i) locating means carried by said support means for movement between a first at rest disposition and a second disposition wherein the locating means will coact with the single locating object carried by the workpiece when so mounted to the grinding machine and move the workpiece into a predetermined position that facilitates the grinding of the workpiece;

(ii) actuating means carried by said support means and coacting with said locating means to move said locating means between said first disposition and said second disposition thereof;

(iii) actuating arm means rockably carried by said support means and locator arm means roackably carried by said actuating arm means;

(iv) said actuating means coacting with said locating means to rock said actuating arm means towards and away from a workpiece when the workpiece is mounted to the grinding machine;

(v) said actuating arm means carrying said locator arm means towards and away from the workpiece as said actuating arm means is so rocked by said locating means;

(vi) a first fixed stop carried by said support means for coaction with a first stop carried by said actuating arm means and coacting with said first fixed stop to arrest rocking movement of said actuating arm means in said first at rest disposition of said locating means; and (vii) a second fixed stop carried by said support means for coaction with a second stop carried by said actuating arm means and coacting with said second stop to arrest rocking movement of said actuating arm means in said second disposition of said locating means.

36. The grinding machine of claim 35, wherein:

(a) said locator arm means carries a pair of relatively closely spaced locator members which are disposed thereon for coaction with the single locating object when said locator arm means is carried by said actuating arm means into said second disposition; and (b) said locator arm means further carrying spring means disposed for coaction with said actuating arm means as said actuating arm means moves towards said second disposition thereof and prior to said actuating arm means being arrested in said second disposition thereof;

(c) said locator arm means being rocked with respect to said actuating arm means upon coaction between said locator members and the single locating object and thereby effecting movement of the workpiece into said predetermined position thereof.

37. The grinding machine of claim 36, wherein said locator members are carried by a shoe that is, in turn, adjustably carried by said locator arm means.

38. The grinding machine of claim 37, wherein the workpiece is a cam shaft carrying proximate one end thereof a sprocket and the single locating object is a timing tooth carried by the sprocket, said locator members comprising a pair of teeth having configurations that correspond to and coact with the timing tooth.

39. The grinding machine of claim 38, including:

(a) a first proximity swith disposed proximate said actuating arm means to sense and indicate that said actuating arm means is in said first disposition thereof; and (b) a second proximity swith disposed proximate said actuating arm means to sense and indicate that said actuating arm means is in said second disposition thereof.

40. The grinding machine of claim 39, wherein said actuating means includes a rotary actuator.

* * * * *